US007594656B2

(12) United States Patent
Maruyama et al.

(10) Patent No.: US 7,594,656 B2
(45) Date of Patent: Sep. 29, 2009

(54) PAPER FEED MECHANISM

(75) Inventors: Takahito Maruyama, Fukushima-ken (JP); Yuji Inada, Fukushima-ken (JP); Masaki Saito, Fukushima-ken (JP); Yoshibumi Abe, Fukushima-ken (JP); Takefumi Osaka, Fukushima-ken (JP); Zenko Motoki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 233 days.

(21) Appl. No.: 11/486,806

(22) Filed: Jul. 14, 2006

(65) Prior Publication Data

US 2007/0018386 A1 Jan. 25, 2007

(30) Foreign Application Priority Data

Jul. 20, 2005 (JP) ..... 2005-209491
Sep. 14, 2005 (JP) ..... 2005-266933

(51) Int. Cl.
*B65H 5/02* (2006.01)

(52) U.S. Cl. ..... 271/272; 400/634; 400/636; 400/637; 400/638; 400/639; 347/101; 347/104

(58) Field of Classification Search ..... 271/272; 400/634, 636–639; 347/101, 104
See application file for complete search history.

(56) References Cited

U.S. PATENT DOCUMENTS 4,375,971 A * 3/1983 Moll ..... 493/442
5,163,674 A * 11/1992 Parks ..... 271/274
5,193,800 A * 3/1993 Kashiwabara ..... 271/272
5,291,224 A * 3/1994 Asano et al. ..... 346/134
5,496,020 A * 3/1996 Takemoto et al. ..... 271/9.01
5,636,929 A * 6/1997 Asano et al. ..... 400/641
5,645,361 A * 7/1997 Mitsushima et al. ..... 400/636
5,793,399 A * 8/1998 Kawakami et al. ..... 347/104
5,971,638 A * 10/1999 Sato et al. ..... 400/578
6,059,287 A * 5/2000 Bae ..... 271/315
6,287,033 B1 * 9/2001 Hatakeyama et al. ..... 400/636
6,305,859 B2 * 10/2001 Shida ..... 400/636
6,499,640 B2 * 12/2002 Lori et al. ..... 226/88
6,540,218 B2 * 4/2003 Tsukada et al. ..... 271/18.3
6,550,907 B2 * 4/2003 Uchida ..... 347/104
6,612,236 B2 * 9/2003 Frankenberger et al. ..... 101/232
6,619,795 B1 * 9/2003 Hiramatsu ..... 347/104
7,232,269 B2 * 6/2007 Ohyama ..... 400/642
7,334,890 B2 * 2/2008 Nakamura ..... 347/104
2003/0048345 A1 * 3/2003 Matsumoto ..... 347/104
2004/0160475 A1 * 8/2004 Satoh et al. ..... 347/36
2004/0251617 A1 * 12/2004 Tsukada et al. ..... 271/272
2006/0071421 A1 * 4/2006 Itoh ..... 271/272

FOREIGN PATENT DOCUMENTS

JP H10-119374 5/1998

* cited by examiner

*Primary Examiner*—Patrick H Mackey
*Assistant Examiner*—Prasad V Gokhale
(74) *Attorney, Agent, or Firm*—Brinks Hofer Gilson & Lione

(57) ABSTRACT

A paper feed mechanism is provided. The paper feed mechanism includes a pair of paper feed rollers at the upstream side and the downstream side of a printing device in a direction in which a recording paper is fed during printing, and press contact rollers in press contact therewith. The back surface of the recording paper receives a pushing force from projections formed on the pair of paper feed rollers by a predetermined depth such that the recording paper is fed during printing by the printing device.

9 Claims, 6 Drawing Sheets

PAPER FEED MECHANISM

This application claims the benefit of the Japanese Patent Application No. 2005-209491 filed on Jul. 20, 2005 and Japanese Patent Application No. 2005-266933 filed on Sep. 14, 2005 both of which are hereby incorporated by reference.

BACKGROUND

1. Field

A paper feed mechanism is provided.

2. Related Art

FIG. 11 is a view schematically showing a generally employed paper feed mechanism 40 disclosed in Patent Application Publication No. H10-119374, which includes a metal cylindrical paper feed roller 41 on which protrusive portions 43 each having a predetermined width are formed at predetermined intervals. The protrusive portion 43 includes a plurality of projections 42 each having a predetermined height, a predetermined pitch, and an acute-angled top end on an outer peripheral surface of the paper feed roller 41 in the longitudinal direction.

Press contact rollers 45 are disposed opposite to the protrusive portions 43 such that a sheet of recording paper 44 is in tight contact with the paper feed roller 41 at a predetermined contact pressure.

As the press contact rollers 45 press the recording paper 44, the projections 42 of the protrusive portions 43 are pushed into the back surface of the recording paper 44. In this state, the paper feed roller 41 is driven to rotate such that the recording paper 44 formed as a board is fed while printing.

Referring to FIG. 12, a printer 46 equipped with the paper feed mechanism 40 further includes a platen roller 47 to the right of the paper feed roller 41. A thermal head 48 is allowed to be in contact with (head-down) or released from (head-up) the platen roller 47.

For the purpose of printing the color image on the recording paper 44 as the board such as a photographic printing paper, the generally employed paper feed mechanism 40 is operated to feed the recording paper 44 from the upstream side at the right side of the drawing to be interposed between the paper feed roller 41 that rotates in the direction of an arrow A and the press contact rollers 45 while holding the thermal head 48 in the head-up state. Different ink colors are printed on the recording paper 44 by performing the head-down and head-up operations of the thermal head 48 repeatedly as well as feeding the recording paper 44 back and forth in directions of A and B repeatedly such that a desired color image is printed.

The head-down operation of the thermal head 48 is performed at a starting position where a top edge 44*a* of the recording paper 44 is gripped between the paper feed roller 41 and the press contact roller 45 so as to start printing.

With the aforementioned structure, the printing cannot be performed in the area of the recording paper 44 from the top edge 44*a* to at least the distance of C. The resultant margin may waste the recording paper 44, thus leading to the cost increase.

SUMMARY

A paper feed mechanism according to a first embodiment includes a printing device capable of printing a desired image on a sheet of recording paper, and paper feed rollers capable of feeding the recording paper to the printing device. In the paper feed mechanism, a plurality of projections arranged at predetermined pitches in an axial direction and a circumferential direction and having a predetermined height are formed on the outer peripheries of the surface of each of the paper feed rollers. The paper feed rollers and press contact rollers in press contact therewith are provided at an upstream side and a downstream side of the printing device in a direction in which the recording paper is fed during printing. The recording paper that is subjected to printing by the printing device is fed while receiving a pushing force from the plurality of projections on the paper feed rollers into a back surface of the recording paper by a predetermined depth.

The paper feed rollers include a first paper feed roller provided at the upstream side of the printing device, and a second paper feed roller provided at the downstream side of the printing device. Traces formed by the pushing force from the projections on the first paper feed roller on the recording paper and traces formed by the pushing force from the projections of the second paper feed roller on the recording paper are displaced from each other so as not to overlap.

The first and the second paper feed rollers are displaced from each other in the axial direction, and the traces are formed to be displaced from each other on the recording paper so as not to overlap.

The first and the second paper feed rollers are displaced from each other by about ½ of a pitch of the projections.

The projections of the first and the second paper feed rollers are displaced from each other in the circumferential direction such that the traces formed on the recording paper are displaced so as not to overlap.

A paper feed mechanism according to a second embodiment includes a printing device capable of printing a desired image on a sheet of recording paper, and paper feed rollers capable of feeding the recording paper to the printing device. In the paper feed mechanism, the paper feed rollers include a first paper feed roller provided at the upstream side of the printing device, and a second paper feed roller provided at the downstream side of the printing device in a direction in which the recording paper is fed during printing. Protrusive portions each having a predetermined width in an axial direction are formed on the outer peripheries of the surfaces of the first and the second paper feed rollers, including a plurality of projections arranged at a predetermined pitch and having a predetermined height.

The projections of the first and the second paper feed rollers are arranged such that the position at which the recording paper receives a pushing force from the projections on the first paper feed roller is different from that at which the recording paper receives a pushing force from the projections on the second paper feed roller except for a group of the projections.

The projections formed on the first and the second paper feed rollers are aligned such that virtual lines formed by connecting adjacent projections become diagonal with respect to the axial direction at predetermined angles, and the predetermined angles of the diagonal virtual lines on the first paper feed roller is different from those of the diagonal virtual lines on the second paper feed roller.

A paper feed mechanism according to a third embodiment includes a printing device capable of printing a desired image on a sheet of recording paper, and paper feed rollers capable of feeding the recording paper to the printing device. In the paper feed mechanism, the paper feed rollers include a first paper feed roller provided at the upstream side of the printing device, and a second paper feed roller provided at the downstream side of the printing device in a direction in which the recording paper is fed during printing. Protrusive portions each having a predetermined width in an axial direction are formed on the outer peripheries of the surfaces of the first and the second paper feed rollers, including a plurality of projections arranged at a predetermined pitch and having a predetermined height. The end portions of the protrusive portions are diagonal with respect to the axial direction of the first and the second paper feed rollers at predetermined angles.

The protrusive portions of the first and the second paper feed rollers are diagonal with respect to the axial direction at the predetermined angles in opposite directions with respect to each other.

The protrusive portions of the first and the second paper feed rollers are diagonal at the same angle in opposite directions with respect to each other.

The plurality of projections of the protrusive portions on the first and the second paper feed rollers are displaced from each other in a circumferential direction such that a position at which the recording paper receives a pushing force from the projections of the first paper feed roller does not overlap with that at which the recording paper receives a pushing force from the projections of the second paper feed roller.

In the paper feed mechanism according to the first embodiment, a plurality of projections arranged at predetermined pitches in an axial direction and a circumferential direction and having a predetermined height are formed on the outer peripheries of the surface of each of the paper feed rollers. The paper feed rollers and press contact rollers in press contact therewith are provided at an upstream side and a downstream side of the printing device in a direction in which the recording paper is fed during printing. The recording paper that is subjected to printing by the printing device is fed while receiving a pushing force from the plurality of projections on the paper feed rollers into a back surface of the recording paper by a predetermined depth. The resultant paper feed mechanism is capable of accurately feeding the recording paper during printing, and of realizing high quality image printing.

In the embodiment, the paper feed rollers include a first paper feed roller provided at the upstream side of the printing device, and a second paper feed roller provided at the downstream side of the printing device. Traces formed by the pushing force from the projections on the first paper feed roller on the recording paper and traces formed by the pushing force from the projections of the second paper feed roller on the recording paper are displaced from each other so as not to overlap. As the projections formed on the first and the second paper feed rollers are displaced from each other, the traces formed by a pushing force applied thereby do not overlap, thus performing the accurate paper feeding.

In the embodiment, the first and the second paper feed rollers are displaced from each other in the axial direction, and the traces are formed to be displaced from each other on the recording paper so as not to overlap. This makes it possible to feed the recording paper with high accuracy during printing.

In the embodiment, as the first and the second paper feed rollers are displaced from each other by about ½ of a pitch of the projections, the traces formed by a pushing force applied by the projections are not overlapped.

In the embodiment, as the projections of the first and the second paper feed rollers are displaced from each other in the circumferential direction such that the traces formed on the recording paper are displaced so as not to overlap, the recording paper may be fed with high accuracy during printing.

In the paper feed mechanism according to the second embodiment, protrusive portions each having a predetermined width in an axial direction are formed on the outer peripheries of the surfaces of the first and the second paper feed rollers, including a plurality of projections arranged at a predetermined pitch and having a predetermined height. The projections of the first and the second paper feed rollers are arranged such that the position at which the recording paper receives a pushing force from the projections on the first paper feed roller is different from that at which the recording paper receives a pushing force from the projections on the second paper feed roller except for a group of the projections. The paper feed mechanism including the first and the second paper feed rollers makes it possible to perform the full page printing on the recording paper from its top to bottom edges, thus eliminating the waste of the recording paper and reducing costs. It is structured such that a portion of the recording paper into which the projections on the first paper feed roller apply the pushing force is different from the portion of the recording paper into which the projections on the second paper feed roller apply the pushing force except a certain group of projections. The recording paper may be fed with high accuracy during printing, resulting in high quality image printing.

In the embodiment, the projections formed on the first and the second paper feed rollers are aligned such that virtual lines formed by connecting adjacent projections become diagonal with respect to the axial direction at predetermined angles, and the predetermined angles of the diagonal virtual lines on the first paper feed roller is different from those of the diagonal virtual lines on the second paper feed roller. The portion of the recording paper into which the projections of the first paper feed roller apply the pushing force is different from that of the recording paper into which the projections of the second paper feed roller apply the pushing force except a certain group of projections. This makes it possible to feed the recording paper with further improved accuracy.

In the sheet feeder mechanism according to the third embodiment, protrusive portions each having a predetermined width in an axial direction are formed on the outer peripheries of the surfaces of the first and the second paper feed rollers, including a plurality of projections arranged at a predetermined pitch and having a predetermined height, and the end portions of the protrusive portions are diagonal with respect to the axial direction of the first and the second paper feed rollers at predetermined angles. The paper feed mechanism equipped with a pair of paper feed rollers allows a full page printing of the recording paper from its top to bottom edges, thus eliminating waste of the recording paper as well as reducing the costs. As the protrusive portions are formed on the outer peripheries of the surface of the paper feed rollers diagonally, the traces on the recording paper formed by the pushing force from the projections are arranged into a zigzag shape. This makes it possible to increase the number of projections pushed into the recording paper.

The protrusive portions of the first and the second paper feed rollers are diagonal with respect to the axial direction at the predetermined angles in opposite directions with respect to each other. This makes it possible to increase the area of the zigzag traces formed on the recording paper, thus reliably feeding the recording paper.

As the protrusive portions of the first and the second paper feed rollers are diagonal at the same angle in opposite directions with respect to each other, the same paper feed rollers may be oppositely combined. The first and the second paper feed rollers may be the same, thus improving the manufacturing efficiency.

The plurality of projections of the protrusive portions on the first and the second paper feed rollers are displaced from each other in a circumferential direction such that a position at which the recording paper receives a pushing force from the projections of the first paper feed roller does not overlap with that at which the recording paper receives a pushing force from the projections of the second paper feed roller. The recording paper may be accurately fed, thus printing the image with higher accuracy.

DRAWINGS

DESCRIPTION OF THE PREFERRED EMBODIMENTS

Figure 1:
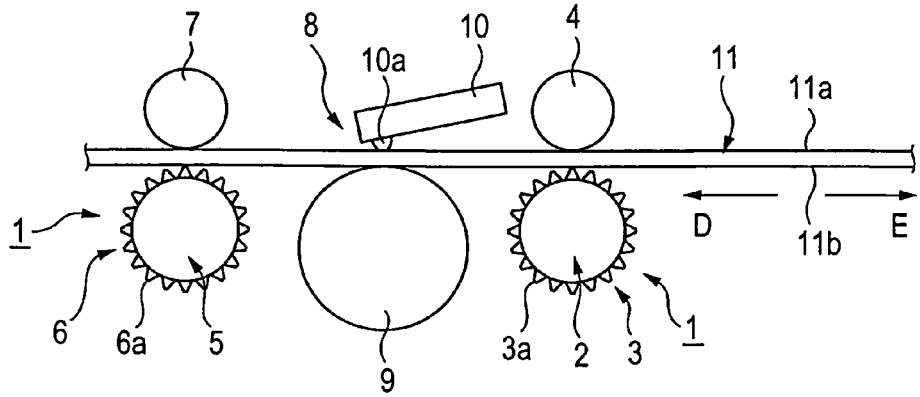
FIG. 1 is a schematic view of a printer that employs a paper feed mechanism according to a first embodiment.

A paper feed mechanism according to the preferred embodiments will be described referring to the drawings.

A paper feed mechanism 1 according to a first embodiment includes a metal cylindrical first paper feed roller 2 provided upstream of a printing device 8 in a feeding direction of a recording paper 11 to be described later, for example, a direction D so as to be rotatably driven both clockwise and counterclockwise.

A plurality of projections 3*a* are equally spaced on the outer peripheral surface of a first paper feed roller 2 at a pitch p in the axial direction and a pitch t in the circumferential direction to form protrusive portions 3, each having a predetermined width.

The projections 3*a* are arranged at the pitch p in the range of about 0.2 mm to about 1.0 mm, each of which has a height from the outer peripheral surface of the first paper feed roller 2 in the range of about 40 μm to about 100 μm.

The projections 3*a* are arranged at the pitch t in the circumferential direction in the range of about 0.4 mm to about 1.0 mm. A first press contact roller 4 formed of a hard rubber is disposed above the first paper feed roller 2 so as to be in press contact therewith.

The first press contact roller 4 is structured to rotatably follow the rotation of the first paper feed roller 2.

The paper feed mechanism 1 of the present invention is equipped with a second paper feed roller 5 downstream of the printing device 8 to be described later so as to be rotatably driven.

A plurality of projections 6*a* are arranged on the outer peripheral surface of the second paper feed roller 5 at the approximately the same pitches p and t as those of the projections 3*a* to form protrusive portions 6, each having a predetermined width.

A second press contact roller 7 formed of a hard rubber is disposed above the second paper feed roller 5 so as to be in press contact therewith.

The second press contact roller 7 is structured to rotatably follow the rotation of the second paper feed roller 5.

The printer equipped with the paper feed mechanism 1 of the present invention includes the printing device 8 disposed between the first and the second paper feed rollers 2 and 5. The printing device 8 includes a cylindrical platen roller 9, and a thermal head 10 disposed above the platen roller 9 such that a heat generating portion 10*a* may be brought into contact with (head-down operation) or released from (head-up operation) the outer peripheral surface of the platen roller 9.

The recording paper 11 formed as a board, for example, photographic printing paper may be fed in the directions of D and E between the platen roller 9 and the thermal head 10 such that the color images are printed thereon.

The upper surface of the printing paper 11 shown in the drawing is a printed surface 11*a* on which the color images are printed. The projections 3*a* and 6*a* on the first and the second paper feed rollers 2 and 5 are pushed into a back surface 11*b* as the lower surface of the recording paper 11 in the drawing by a predetermined depth.

Figure 2:
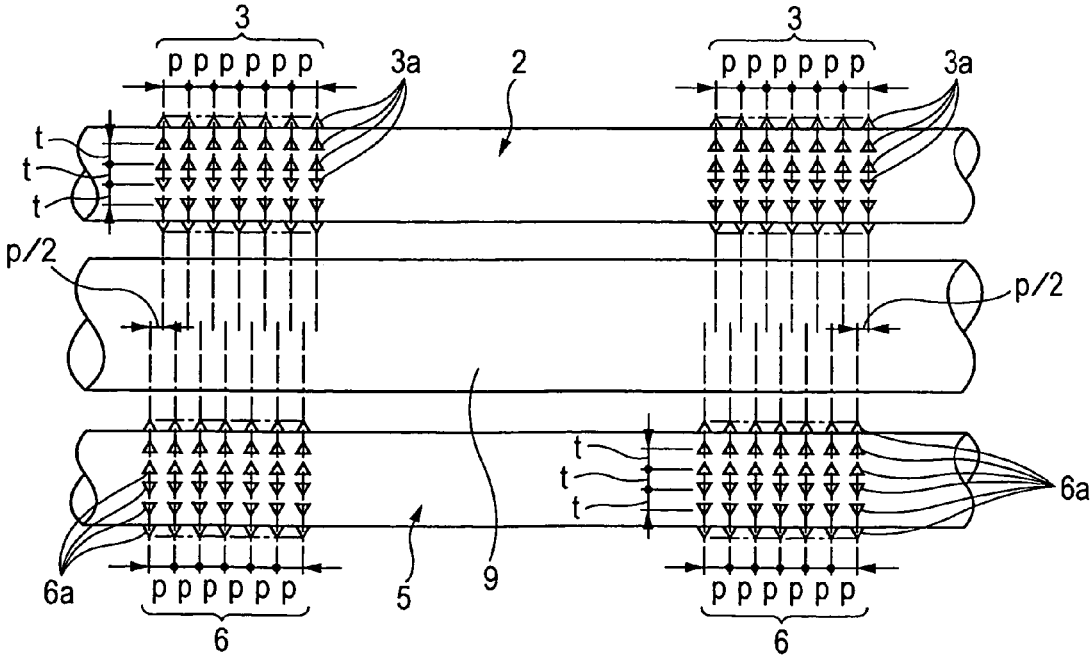
FIG. 2 is a schematic view that shows a positional relationship between a first paper feed roller and a second paper feed roller.

FIG. 2 represents the positional relationship between the projections 3*a* and 6*b* formed on the first and the second paper feed rollers 2 and 5 of the paper feed mechanism 1 according to a preferred embodiment. Referring to FIG. 2, the first and the second rollers 2 and 5 are displaced from each other in the axial direction.

Figure 3:
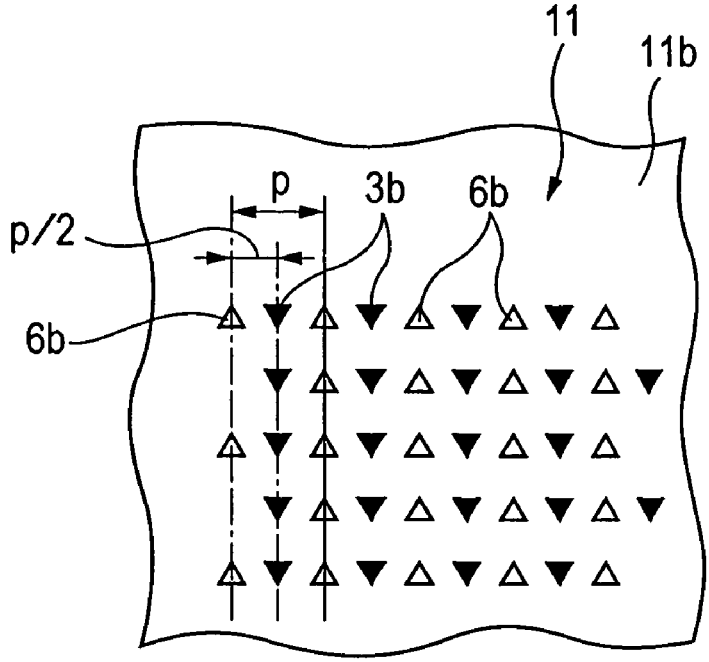
FIG. 3 is a schematic view that shows traces formed by the pushing force from the projections on the paper feed roller.

As the recording paper 11 is fed during printing, the projections 3*a* and 6*a* on the first and the second paper feed rollers 2 and 5 are pushed into the back surface 11*b* of the recording paper 11 to leave traces 3*b* and 6*b* as shown in FIG. 3.

The projections 3*a* and 6*a* are displaced from each other by p/2 as shown in FIG. 2 such that the resultant traces 3*b* and 6*b* formed by the pushing force from the projections 3*a* and 6*a* on the back surface 11*b* of the recording paper 11 does not overlap.

The printer equipped with the above-structured paper feed mechanism 1 will be described taking a thermoelectric printer for example referring to FIG. 1. The recording paper 11 is gripped between the first paper feed roller 2 and the press contact roller 4 while holding the thermal head 10 in the head-down state. The recording paper 11 is fed toward the downstream side in the direction of the arrow D by rotating the paper feed roller 2 counterclockwise. As the recording paper 11 is fed by the feeding force generated by the first paper feed roller 2, the top edge of the recording paper 11 serves to move the thermal head 10 in the head-down state upward. This embodiment makes it possible to have a sublimation printing of the first ink of the ink ribbon on the recording paper 11 from the top edge thereof.

As the platen roller 9 has been rotatably driven counterclockwise, the recording paper 11 pressed against the thermal head 8 may be smoothly fed toward the downstream side in the direction of D. This may prevent the recording paper 11 formed as the board from being bent between the first paper feed roller 2 and the platen roller 9.

The recording paper 11 printed from the top edge is further gripped between the second paper feed roller 5 and the second press contact roller 7. The second paper feed roller 5 is rotatably driven counterclockwise such that the recording paper 11 is fed toward the downstream side after printing.

Figure 4:
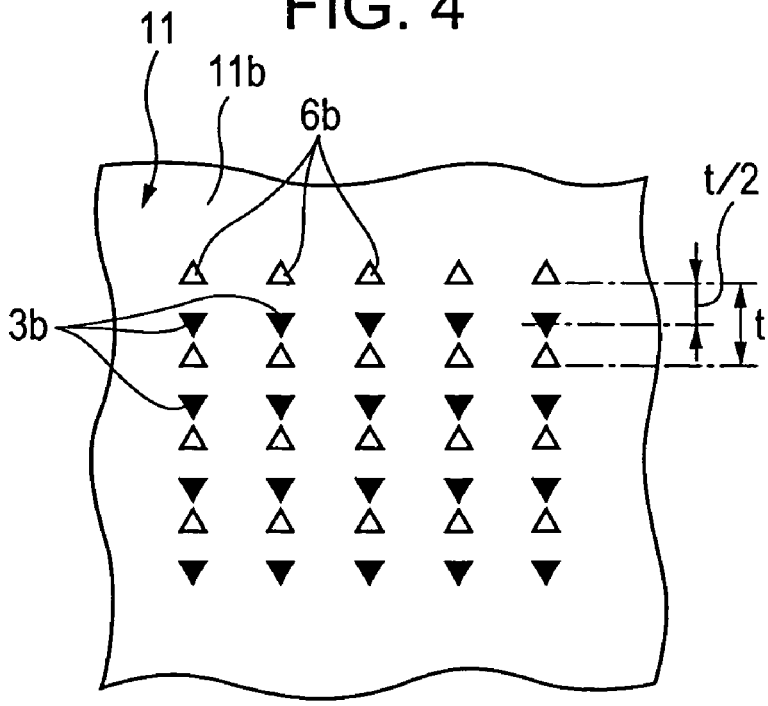
FIG. 4 is a schematic view that shows traces formed by the pushing force from the projections on the paper feed roller.

Referring to FIGS. 3 and 4, the traces 3*b* formed by the pushing force from the projections 3*a* on the recording paper 11 are displaced from the traces 6*b* formed by the pushing force from the projections 6*a* on the recording paper 11 so as not to overlap.

When the full page printing of the first color to the bottom edge of the recording paper 11 has been performed, the thermal head 10 is brought into the head-up state, and the first and the second paper feed rollers 2 and 5 are rotated clockwise. The recording paper subjected to the first color printing is fed back to the upstream side in the direction of an arrow E.

The projections 3*a* and 6*a* on the first and the second paper feed rollers 2 and 5 are pushed into the traces 3*b* and 6*b* that have been formed thereby respectively on the recording paper 11 to be fed back to the upstream side in the direction of the arrow E. This makes it possible to feed the recording paper 11 backward with high accuracy without causing the displacement.

This allows the projections 3*a* and 6*a* on the first and the second paper feed rollers 2 and 5 to be pushed into the same traces 3*b* and 6*b* repeatedly irrespective of the displacement between the respective pitches p and t of the projections 3*a* and 6*a*.

When the recording paper 11 is fed backward until the top edge of the recording paper 11 reaches the heat generating portion 10*a* of the thermal head 10, each clockwise rotation of the first and the second paper feed rollers 2 and 5 is stopped, and the thermal head 10 is brought into the head-down state.

The first and the second paper feed rollers 2 and 5 are rotatably driven counterclockwise, and the platen roller 9 is rotatably driven such that the second ink color is printed over the first printed image on the recording paper 11 from the top to bottom edges for the full page printing. The desired color image may be printed on the recording paper from its top edge to the bottom edge by repeating the aforementioned operations.

Figure 5:
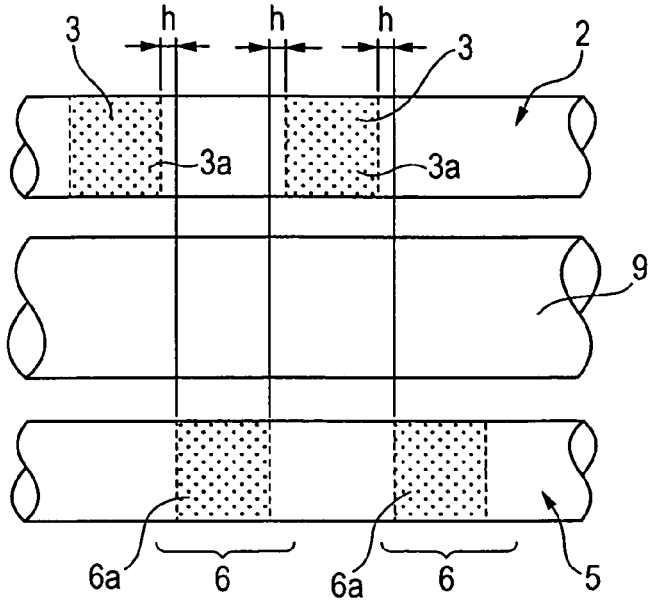
FIG. 5 is a schematic view that shows a preferred embodiment.

In the first embodiment, the projections 3*a* and 6*a* of the first and the second paper feed rollers 2 and 5 are displaced from each other by P/2. The first and the second protrusive portions 3 and 6 may be arranged to be displaced by h as shown in FIG. 5 so as not to overlap.

In the preferred embodiment embodiment, the first and the second protrusive portions 3 and 6 are formed at two positions on the first and the second paper feed rollers 2 and 5. However, the first and the second protrusive portions 3 and 6 may be formed at three positions on the respective paper feed rollers.

Arbitrary numbers of projections 3*a* and 6*a* may be provided to form the first and the second protrusive portions 3 and 6. Those numbers do not have to be constant, but may be variable in accordance with the size of the recording paper 11.

Figure 6:
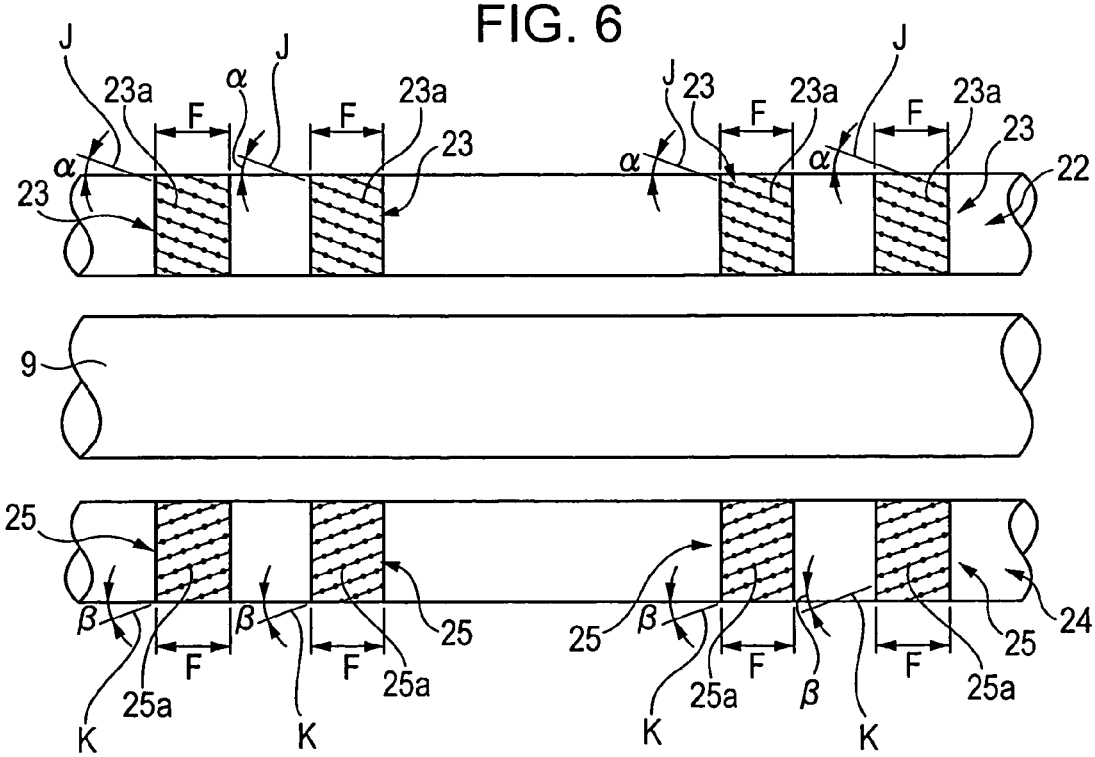
FIG. 6 is a schematic view that shows the first and the second paper feed rollers according to a second embodiment.

A paper feed mechanism 21 according to a second embodiment is substantially the same as that of the first embodiment except that the first and the second paper feed rollers 2 and 5 are replaced by the first and the second paper feed rollers 22 and 24 as shown in FIG. 6. The first and the second paper feed rollers 22 and 24 will be described hereinafter.

First protrusive portions 23 each having a width F in the axial direction are formed on the outer peripheries of the surfaces of the first paper feed roller 22. The first protrusive portion 23 includes a plurality of first projections 23*a* arranged at a predetermined pitch and has a predetermined height. The first projections 23*a* are aligned at the predetermined pitch such that each virtual line J formed by connecting adjacent first projections 23*a* is diagonal at an angle α with respect to the axis of the first paper feed roller 22.

The adjacent first projections 23*a* on the virtual line J diagonal at the angle α are arranged at a pitch p in the range of about 0.2 mm to about 1.0 mm, and project at the height from the outer peripheral surface of the first paper feed roller 22 in the range of about 40 μm to about 100 μm.

The first projections 23*a* are arranged at the pitch t in the circumferential direction in the range of about 0.2 mm to about 1.0 mm. The first press contact roller 4 formed of a hard rubber is provided above the first paper feed roller 22 so as to be in press contact therewith. The first press contact roller 4 is structured to rotatably follow the rotation of the first paper feed roller 22.

Second protrusive portions 25 each having a width F in the axial direction are formed on the outer peripheral surface of the second paper feed roller 24 likewise the first paper feed roller 22. A plurality of second projections 25*a* likewise the first projections 23*a* are formed to define the second protrusive portions 25. The second projections 25*a* are aligned at the predetermined pitch such that each virtual line K formed by connecting adjacent second projections 25*a* is diagonal at the angle β with respect to the axis of the second paper feed roller 24.

The diagonal angles α and β of the virtual lines J and K respectively formed by connecting the first and the second projections 23*a* and 25*a* on the first and the second paper feed rollers 22 and 24 have different values.

In this preferred embodiment, the first and the second projections 23*a* and 25*a* are formed on the first and the second paper feed rollers 22 and 24 such that the virtual lines J and K formed by connecting the first and the second projections 23*a* and 25*a* are diagonal at different angles α and β with respect to the axis of the paper feed rollers. In this embodiment, the diagonal angle of the virtual line J is different from that of the virtual line K. Both the virtual lines J and K may be diagonal at the same angle.

The second press contact roller 7 formed of a hard rubber is disposed above the second paper feed roller 24 so as to be in press contacted therewith.

The second press contact roller 7 is structured to rotatably follow the rotation of the second paper feed roller 24.

Figure 7:
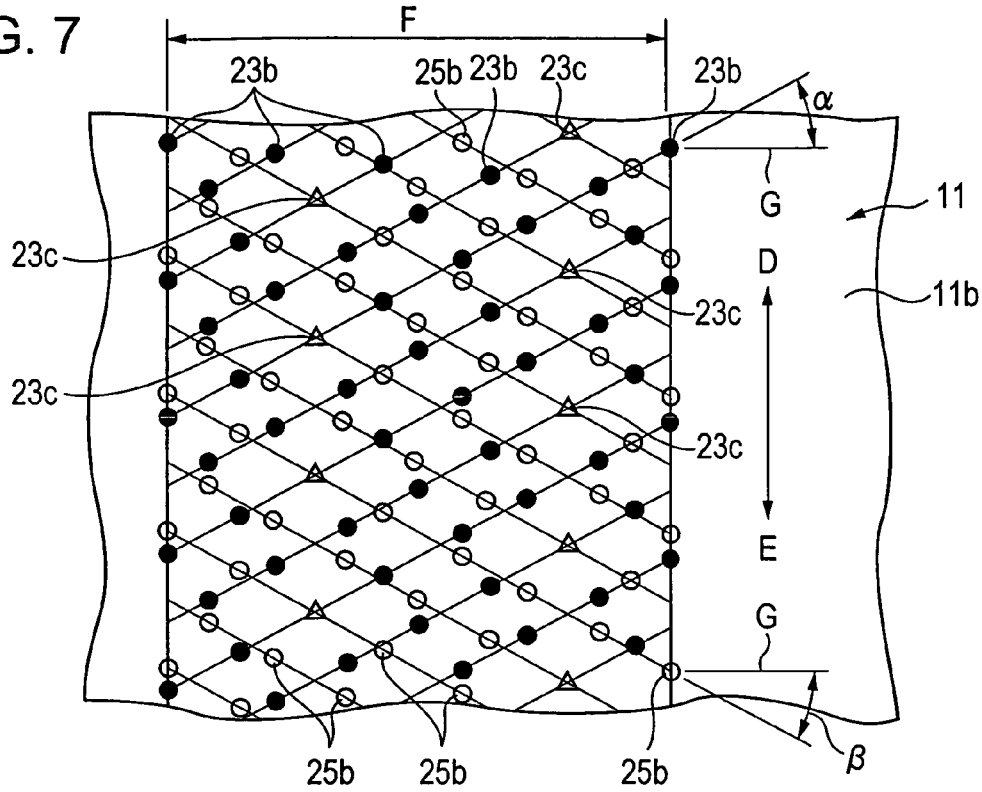
FIG. 7 is a schematic view that shows traces formed by the pushing force from the projections on the first and the second paper feed rollers according to the second embodiment.
Figure 8:
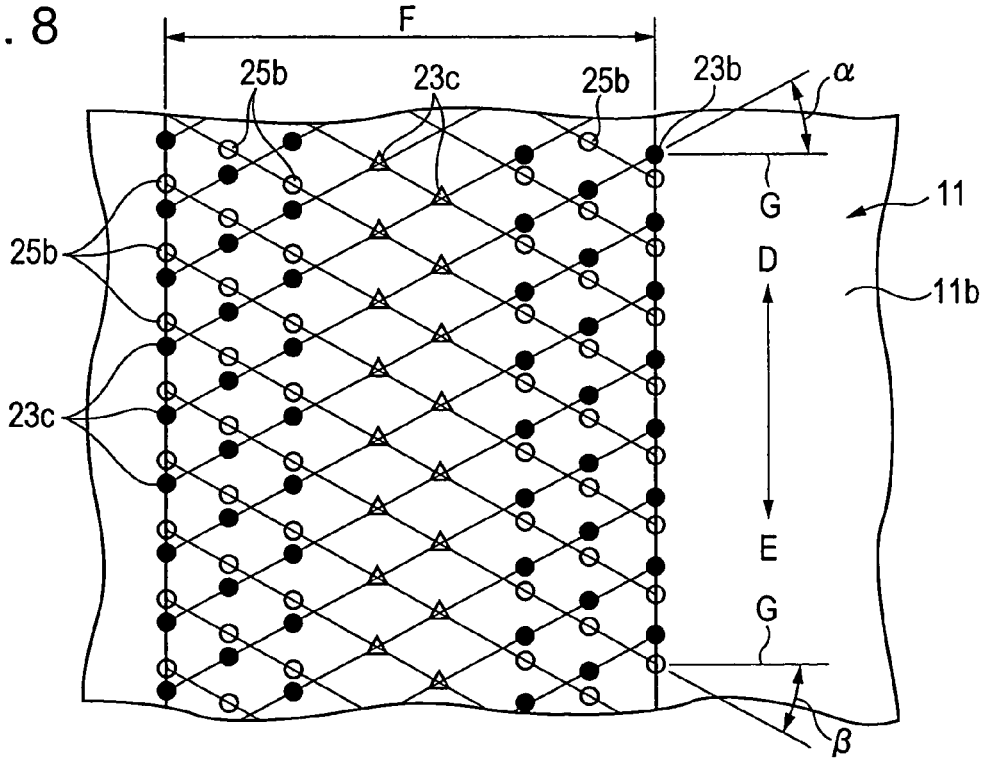
FIG. 8 is a schematic view that shows traces formed by the pushing force from the projections of the first and the second paper feed rollers according to the second embodiment.

In the paper feed mechanism 21 according to the second embodiment, the first and the second projections 23*a* and 25*a* on the first and the second paper feed rollers 22 and 24 are pushed into the back surface 11*b* of the recording paper 11 to be fed during printing such that the first and the second traces 23*b* and 25*b* are formed at the positions into which the first and the second projections 23*a* and 25*a* are pushed as shown in FIG. 7.

The first traces 23*b* shown as filled circles are aligned such that the virtual lines J are diagonal at the angle α with respect to the line G in parallel with the axis of the first paper feed roller 22. The second traces 25*b* shown as unfilled circles are aligned such that the virtual lines K are diagonal at the angle β that is different from the angle α.

With the paper feed mechanism 21 according to the second embodiment, traces 23*c* shown as unfilled triangles are defined by the first and the second traces 23*b* and 25*b* that partially overlap. Most of the first and the second traces 23*b* and 25*b* are arranged so as not to overlap.

The projections 23*a* and 25*a* on the first and the second paper feed rollers 22 and 24 are arranged such that positions on the recording paper 11 that receive the pushing force from the first projections 23*a* on the first paper feed roller 22 are different from those that receive the pushing force from the second projections 25*a* on the second paper feed roller 24 except a certain group of projections (that form the overlapped traces 23*c*). This makes it possible to feed the recording paper 11 accurately both in the directions D and E.

The first and the second paper feed rollers 22 and 24 may be structured to displace the first and the second projections 23*a* and 25*a* by the pitch such that the first and the second traces 23*b* and 25*b* at the left and right sides of the width F are arranged to be equally spaced along the circumferential direction.

In the aforementioned embodiment where the first and the second traces 23*b* and 25*b* at both sides of the width F are equally spaced along the circumferential direction, the number of the overlapped traces 23*c* may be reduced.

In the paper feed mechanism 21 according to the second embodiment, the projections that form the protrusive portions each with a predetermined width are arranged to be diagonal with respect to the axial direction. This increases the number of the projections formed in the circumferential direction, and accordingly, the number of the protrusions that are pushed into the back surface 11*b* of the recording paper 11.

In the aforementioned embodiment, the recording paper may be reliably fed by the first and the second paper feed rollers during printing or after printing, resulting in the high quality image printing.

Figure 9:
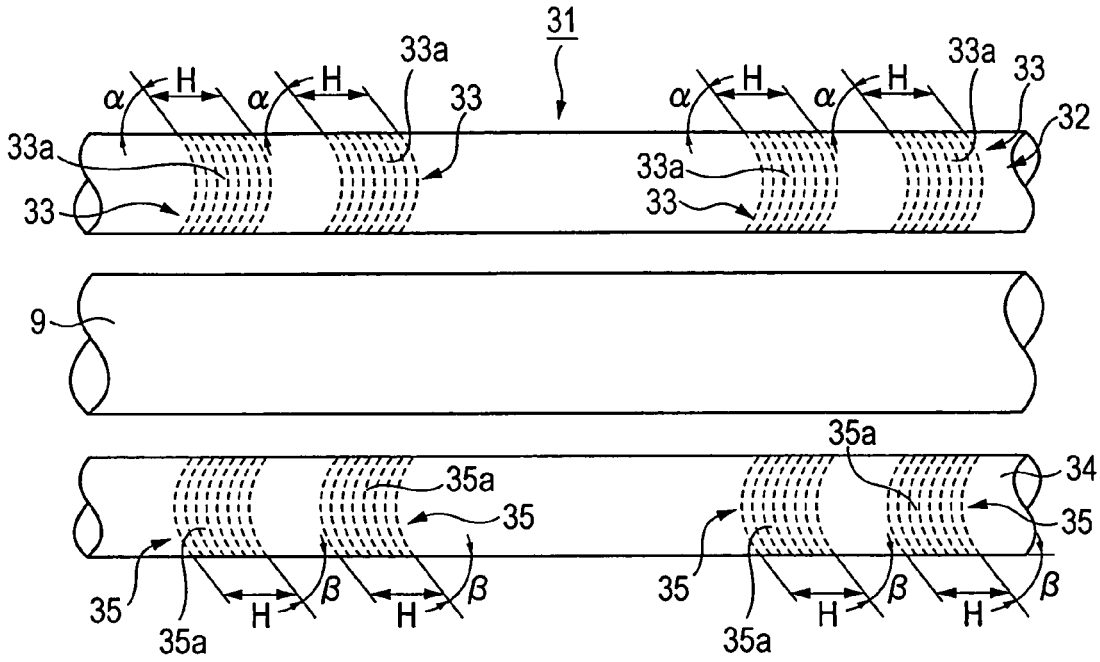
FIG. 9 is a schematic view that shows a first paper feed roller and a second paper feed roller according to a third embodiment.

The paper feed mechanism 31 according to a third embodiment is substantially the same as that of the second embodiment except that the first and the second paper feed rollers 22 and 24 are replaced by the first and the second paper feed rollers 32 and 34 as shown in FIG. 9. The explanation with respect to the first and the second paper feed rollers 32 and 34 will be described hereinafter.

First protrusive portions 33 each having a width H in the axial direction are formed on the outer peripheries of the surfaces of the first paper feed rollers 32. The first protrusive portions 33 include a plurality of first projections 33*a* arranged at a predetermined pitch and have predetermined heights.

The side edge of the first protrusive portion 33 including the plurality of the first projections 33*a* is diagonal at the angle α with respect to the axial direction of the first paper feed roller 32.

Second protrusive portions 35 each having a width H in the axial direction are formed on the outer peripheries of the surfaces of the second paper feed rollers 34. The second protrusive portions 35 include a plurality of second projections 35*a* each arranged at a predetermined pitch having a predetermined height.

The side edge of the second protrusive portion 35 including the plurality of the second projections 35*a* is diagonal at the angle β with respect to the axial direction of the second paper feed roller 34. The second protrusive portions 35 are diagonal at the angle β in the opposite direction of the first protrusive portions 33 diagonal at the angle α. The first and the second protrusive portions 33 and 35 are diagonal in the opposite direction at the same angle.

The first and the second projections 33*a* and 35*a* are arranged at the same pitch and have heights on the first and the second protrusive portions 33 and 35 as in the first embodiment.

Figure 10:
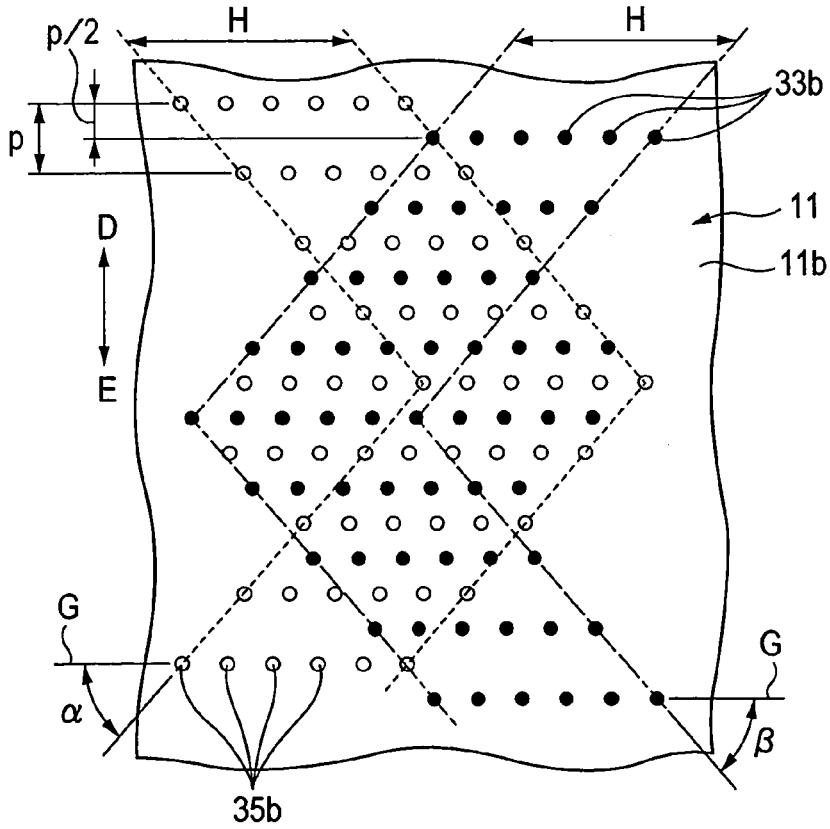
FIG. 10 is a schematic view that shows traces formed by the pushing force from the projections on the first and the second paper feed rollers according to the third embodiment.
Figure 11:
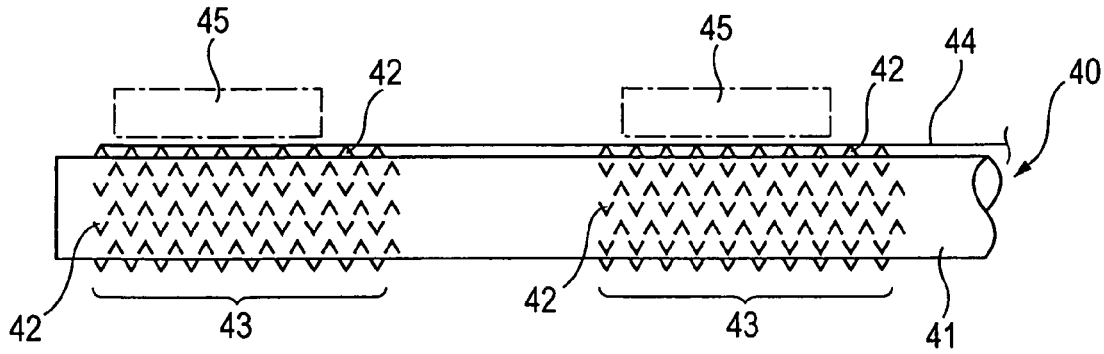
FIG. 11 is a side view of a generally employed paper feed mechanism.
Figure 12:
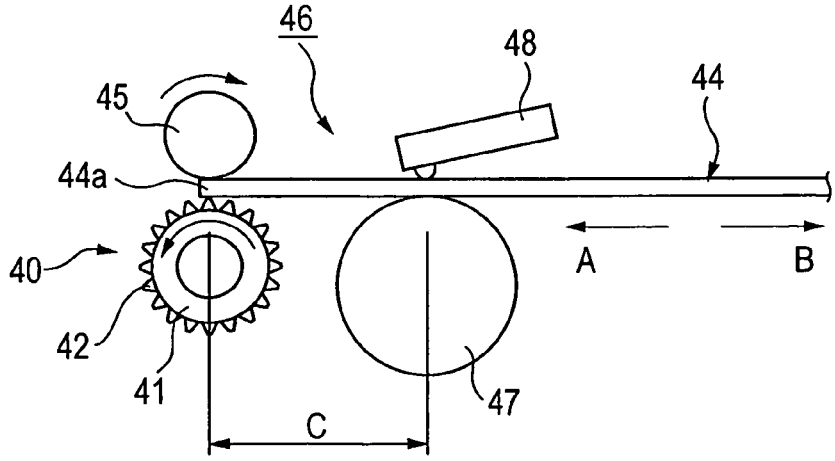
FIG. 12 is a schematic view that shows a printer equipped with the generally employed paper feed mechanism.

The paper feed mechanism 31 according to the third embodiment allows the first and the second projections 33*a* and 35*a* on the first and the second paper feed rollers 32 and 34 to be pushed into the back surface 11*b* of the recording paper 11 fed during printing. The back surface 11*b* of the recording paper 11 has the first traces 33*b* shown as filled circles and second traces 35*b* shown as unfilled circles, which are displaced from each other so as not to overlap. Those traces form a zigzag arrangement with the same width H as that of the first and the second protrusive portions 33 and 35, as shown in FIG. 10.

The first and the second projections 33*a* and 35*a* on the first and the second paper feed rollers 32 and 34 are displaced by the P/2 so as not to overlap. The second traces 35*b* may be formed between the adjacent first traces 33*b* and 33*b* in the axial direction (not shown).

In the third embodiment, the first protrusive portion 33 is diagonal at the angle α opposite to the second protrusive portion 35 diagonal at the angle β. The first and the second protrusive portions 33 and 35 may be diagonal in the same direction, and the first and the second paper feed rollers 32 and 34 are displaced from each other in the axial direction so as not to overlap.

In the embodiment, the first and the second protrusive portions 33 and 35 are diagonal at the same angle in the opposite direction. They may be diagonal at different angles.

In the paper feed mechanism 31 according to the third embodiment, the protrusive portions each having a predetermined width and including the respective projections are diagonal with respect to the axial direction. This may increase the number of the projections in the circumferential direction, and accordingly the number of the projections pushed into the back surface 11*b* of the recording paper 11. This allows the first and the second paper feed rollers to reliably feed the recording paper during or after printing, resulting in the high quality image printing.

What is claimed is:

1. A paper feed mechanism that includes:

a printing device;

a first paper feed roller provided at an upstream side of the printing device, and a second paper feed roller provided at a downstream side of the printing device in a direction in which recording paper is fed during printing, wherein a plurality of projections are formed on the outer peripheries of the surface of each of the first and second paper feed rollers;

a first contact roller in press contact with the first paper feed roller; and a second contact roller in press contact with the second paper feed roller, wherein traces formed by the pushing force from the projections on the first paper feed roller on the recording paper and traces formed by the pushing force from the projections of the second paper feed roller on the recording paper are displaced from each other so as not to overlap, and wherein the recording paper is fed by a pushing force from the plurality of projections on the first and second paper feed rollers into a back surface of the recording paper by a predetermined depth.

2. The paper feed mechanism according to claim 1, wherein the plurality of projections are arranged at predetermined pitches in an axial direction and a circumferential direction and have a predetermined height.

3. A paper feed mechanism comprising: a printing device;

a first paper feed roller provided at an upstream side of the printing device, and a second paper feed roller provided at a downstream side of the printing device in a direction in which recording paper is fed during printing, the first and the second paper feed rollers being displaced from each other in the axial direction;

a first contact roller in press contact with the first paper feed roller; and a second contact roller in press contact with the second paper feed roller, wherein a plurality of projections are formed on the outer peripheries of the surface of each of the first and second paper feed rollers, and traces formed by the pushing force from the projections on the first paper feed roller on the recording paper and traces formed by the pushing force from the projections of the second paper feed roller on the recording paper are displaced from each other so as not to overlap, and wherein the recording paper is fed by a pushing force from the plurality of projections on the first and second paper feed rollers into a back surface of the recording paper by a predetermined depth.

4. The paper feed mechanism according to claim 3, wherein the first and the second paper feed rollers are displaced from each other by ½ of a pitch of the projections.

5. A paper feed mechanism comprising: a printing device;

a first paper feed roller provided at an upstream side of the printing device, and a second paper feed roller provided at a downstream side of the printing device in a direction in which recording paper is fed during printing;

a first contact roller in press contact with the first paper feed roller; and a second contact roller in press contact with the second paper feed roller, wherein a plurality of projections are formed on the outer peripheries of the surface of each of the first and second paper feed rollers, the projections of the first and the second paper feed rollers being displaced from each other in the circumferential direction such that traces formed by the pushing force from the projections of the first paper feed roller on the recording paper and traces formed by the pushing force from the projections of the second paper feed roller on the recording paper are displaced from each other so as not to overlap, and wherein the recording paper is fed by a pushing force from the plurality of projections on the first and second paper feed rollers into a back surface of the recording paper by a predetermined depth.

6. A paper feed mechanism including a printing device capable of printing a desired image on a sheet of recording paper, and paper feed rollers capable of feeding the recording paper to the printing device, wherein:

the paper feed rollers include a first paper feed roller provided at the upstream side of the printing device, and a second paper feed roller provided at the downstream side of the printing device in a direction in which the recording paper is fed during printing;

protrusive portions each having a predetermined width in an axial direction are formed on the outer peripheries of the surfaces of the first and the second paper feed rollers, including a plurality of projections arranged at a predetermined pitch and having a predetermined height: and the projections of the first and the second paper feed rollers are arranged such that the position at which the recording paper receives a pushing force from the projections on the first paper feed roller is different from that at which the recording paper receives a pushing force from the projections on the second paper feed roller except for a group of the projections on the first and the second paper feed rollers, wherein the projections formed on the first and the second paper feed rollers are aligned such that virtual lines formed by connecting adjacent projections become diagonal with respect to the axial direction at predetermined angles, and the predetermined angles of the diagonal virtual lines on the first paper feed roller is different from those of the diagonal virtual lines on the second paper feed roller.

7. A paper feed mechanism including:

a printing device, and paper feed rollers, wherein the paper feed rollers include a first paper feed roller provided at the upstream side of the printing device, and a second paper feed roller provided at the downstream side of the printing device in a direction in which the recording paper is fed during printing;

protrusive portions each having a predetermined width in an axial direction are formed on the outer peripheries of the surfaces of the first and the second paper feed rollers, including a plurality of projections arranged at a predetermined pitch and having a predetermined height; and the end portions of the protrusive portions are diagonal with respect to the axial direction of the first and the second paper feed rollers at predetermined angles, wherein the plurality of projections of the protrusive portions on the first and second paper feed rollers are displaced from each other in a circumferential direction such that a first position at which the recording paper receives a pushing force from the projections of the first paper feed roller does not overlap with a second position at which the recording paper receives a pushing force from the projections of the second paper feed roller.

8. The paper feed mechanism according to claim 7, wherein the protrusive portions of the first and the second paper feed rollers are diagonal with respect to the axial direction at the predetermined angles in opposite directions with respect to each other.

9. The paper feed mechanism according to claim 7, wherein the protrusive portions of the first and the second paper feed rollers are diagonal at the same angle in opposite directions with respect to each other.

* * * * *

UNITED STATES PATENT AND TRADEMARK OFFICE

CERTIFICATE OF CORRECTION

PATENT NO. : 7,594,656 B2
APPLICATION NO. : 11/486806
DATED : September 29, 2009
INVENTOR(S) : Maruyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 310 days.

Signed and Sealed this

Twenty-eighth Day of September, 2010

David J. Kappos

David J. Kappos
*Director of the United States Patent and Trademark Office*